US009348298B2

(12) United States Patent
Matsumoto et al.

(10) Patent No.: US 9,348,298 B2
(45) Date of Patent: May 24, 2016

(54) IMAGE FORMING APPARATUS WITH WASTE TONER COLLECTION CONTAINER

(71) Applicant: CANON KABUSHIKI KAISHA, Tokyo (JP)

(72) Inventors: Hiroshi Matsumoto, Toride (JP); Shinichi Takata, Abiko (JP); Yushi Oka, Abiko (JP); Ryou Sakaguchi, Toride (JP); Kentaro Tamura, Toride (JP); Hiromichi Koseki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/671,066

(22) Filed: Mar. 27, 2015

(65) Prior Publication Data

US 2015/0277346 A1 Oct. 1, 2015

(30) Foreign Application Priority Data

Mar. 31, 2014 (JP) ..... 2014-073169

(51) Int. Cl.
*G03G 21/12* (2006.01)
*G03G 21/10* (2006.01)

(52) U.S. Cl.
CPC ..... *G03G 21/12* (2013.01); *G03G 21/105* (2013.01)

(58) Field of Classification Search
CPC ..... G03G 21/12; G03G 21/10; G03G 21/105
See application file for complete search history.

(56) References Cited

U.S. PATENT DOCUMENTS 8,611,805 B2 * 12/2013 Koike ..... G03G 21/12 399/358
2010/0111582 A1 * 5/2010 Nishimura ..... G03G 21/105 399/360
2012/0163837 A1 * 6/2012 Tomita ..... G03G 21/105 399/13
2013/0183050 A1 * 7/2013 Kwon ..... G03G 21/12 399/35
2014/0044465 A1 * 2/2014 Mekada ..... G03G 21/12 399/358

FOREIGN PATENT DOCUMENTS

JP 4085571 B2 5/2008

OTHER PUBLICATIONS

Machine translation of reference Honobe et al. (JP 4,085,571 B2), Pub Date May 14, 2008.*

* cited by examiner

*Primary Examiner* — Rodney Bonnette
(74) *Attorney, Agent, or Firm* — Fitzpatrick, Cella, Harper & Scinto

(57) ABSTRACT

An image forming apparatus comprising: an image carrier; an image forming unit configured to form a toner image on the image carrier by using toner, based on image information; a transfer unit configured to transfer the toner image formed on the image carrier to a sheet; a cleaning unit configured to clean toner on the image carrier; a collected toner box in which the toner cleaned by the cleaning unit is collected; a rotating member configured to be rotated for moving the toner in the collected toner box; and a controller configured to control, based on the image information, whether or not to rotate the rotating member.

18 Claims, 4 Drawing Sheets

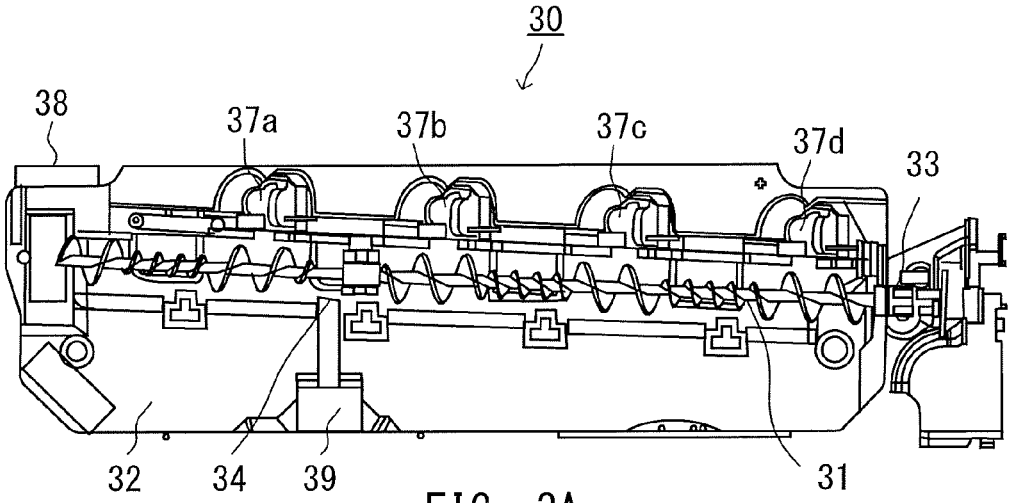
FIG. 3A
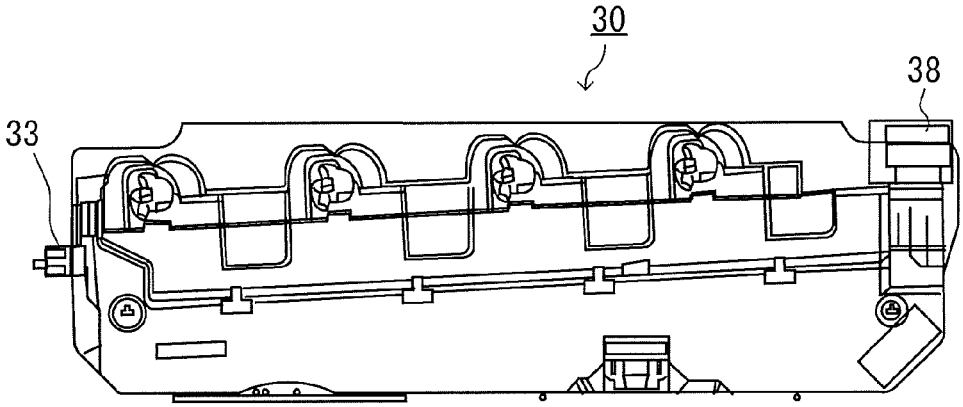
FIG. 3B
| REPLACEMENT OF COLLECTED TONER BOX |
| --- |
| COLLECTED TONER CONTAINER IS FULL.<br><br>PLEASE OPEN FRONT COVER<br>AND REPLACE COLLECTED TONER CONTAINER. |
FIG. 4

FIG. 5A TONER AMOUNT OF IMAGE INFORMATION A

| Y | M | C | K |
|---|---|---|---|
| 70 | 26 | 79 | 27 |

FIG. 5B COLLECTED TONER AMOUNT OF IMAGE INFORMATION A

| V(Y) | V(M) | V(C) | V(K) | V(Tr) |
|---|---|---|---|---|
| 3.5 | 1.3 | 3.95 | 1.35 | 9.60 |

FIG. 5C TONER AMOUNT OF IMAGE INFORMATION B

| Y | M | C | K |
|---|---|---|---|
| 53 | 0 | 53 | 26 |

FIG. 5D COLLECTED TONER AMOUNT OF IMAGE INFORMATION B

| V(Y) | V(M) | V(C) | V(K) | V(Tr) |
|---|---|---|---|---|
| 2.65 | 0 | 2.65 | 1.3 | 6.27 |

FIG. 5E CUMULATIVE TOTAL OF COLLECTED TONER AMOUNT

| Mix(Y) | Mix(M) | Mix(C) | Mix(K) | Mix(Tr) |
|---|---|---|---|---|
| 6.15 | 1.3 | 6.6 | 2.65 | 15.87 |

FIG. 5F STIRRING SCREW OPERATION DETERMINATION THRESHOLD

| Th(Y) | Th(M) | Th(C) | Th(K) | Th(Tr) |
|---|---|---|---|---|
| 250 | 250 | 250 | 250 | 500 |

FIG. 5G CUMULATIVE TOTAL OF COLLECTED TONER AMOUNT FOR 31 SETS (62 PAGES)

| Mix(Y) | Mix(M) | Mix(C) | Mix(K) | Mix(Tr) |
|---|---|---|---|---|
| 190.65 | 40.3 | 204.6 | 82.15 | 491.97 |

FIG. 5H CUMULATIVE TOTAL WHEN PERFORMING IMAGE FORMATION OF IMAGE INFORMATION A AFTER STATE IN FIG. 5G

| Mix(Y) | Mix(M) | Mix(C) | Mix(K) | Mix(Tr) |
|---|---|---|---|---|
| 194.15 | 41.6 | 208.55 | 83.5 | 501.57 |

FIG. 5I STIRRING SCREW OPERATION DETERMINATION THRESHOLD

| Th(Y) | Th(M) | Th(C) | Th(K) | Th(Tr) |
|---|---|---|---|---|
| 250 | 250 | 250 | 300 | 600 |

IMAGE FORMING APPARATUS WITH WASTE TONER COLLECTION CONTAINER

BACKGROUND OF THE INVENTION

1. Field of the Invention

The present disclosure relates to an image forming apparatus such as an electrophotographic copying machine, a laser beam printer and the like.

2. Description of the Related Art

An image forming apparatus performs image forming processing by transferring a toner image formed on a photosensitive drum to a recording medium such as a sheet. Toner sometimes remains on the photosensitive drum after the transfer. The toner remaining on the photosensitive drum (hereinafter referred to as "residual toner") is removed by a cleaner and stored in a collected toner box, provided in the image forming apparatus, as collected toner. The image forming apparatus which forms color images comprises the photosensitive drum for each color. The collected toner box stores the collected toner of each color collected from each of the photosensitive drums. Therefore, the collected toner box needs to have a certain capacity.

When the collected toner box is full of the collected toner, a receiving port of the collected toner is clogged so that the collected toner cannot be collected. In this case, the image forming apparatus prompts a user to replace the collected toner box. The image forming apparatus stops the image forming processing until the collected toner box is replaced.

Japanese Patent Publication No. 4085571 discloses an image forming apparatus which comprises a collected toner box having a plurality of receiving ports of the collected toner. The collected toner is dropped from the receiving port into the collected toner box. A leveling unit is disposed in the collected toner box along the upper limit of the storage space therein. The leveling unit uniformly levels the collected toner stored in the collected toner box to store the collected toner as much as possible.

The image forming apparatus disclosed in Japanese Patent Publication No. 4085571 uniformly levels the collected toner in the collected toner box by the leveling unit at all times. This prevents the collected toner from accumulating in a specific part in the collected toner box. The image forming apparatus, however, causes problems including an occurrence of noise, an increase of consumption power and the like as the leveling unit operates all the time during the image forming processing.

SUMMARY OF THE INVENTION

According to an aspect of the present disclosure, an image forming apparatus includes: an image carrier; an image forming unit configured to form a toner image on the image carrier by using toner, based on image information; a transfer unit configured to transfer the toner image formed on the image carrier to a sheet; a cleaning unit configured to clean toner on the image carrier; a collected toner box in which the toner cleaned by the cleaning unit is collected; a rotating member configured to be rotated for moving the toner in the collected toner box; and a controller configured to control, based on the image information, whether or not to rotate the rotating member.

Further features of the present invention will become apparent from the following description of exemplary embodiments (with reference to the attached drawings).

BRIEF DESCRIPTION OF THE DRAWINGS

FIG. 3A is a schematic cross-sectional diagram of the collected toner box when viewed from front, and FIG. 3B is a schematic cross-sectional diagram of the collected toner box when viewed from back.

FIG. 4 is a diagram illustrating a display message which prompts to replace the collected toner box.

FIGS. 5A to 5I are explanatory diagrams explaining a method to calculate timing to stir.

DESCRIPTION OF THE EMBODIMENTS

Now, an embodiment of the present invention is described in detail referring to the accompanying drawings.

<Configuration of Image Forming Apparatus>

Figure 1:
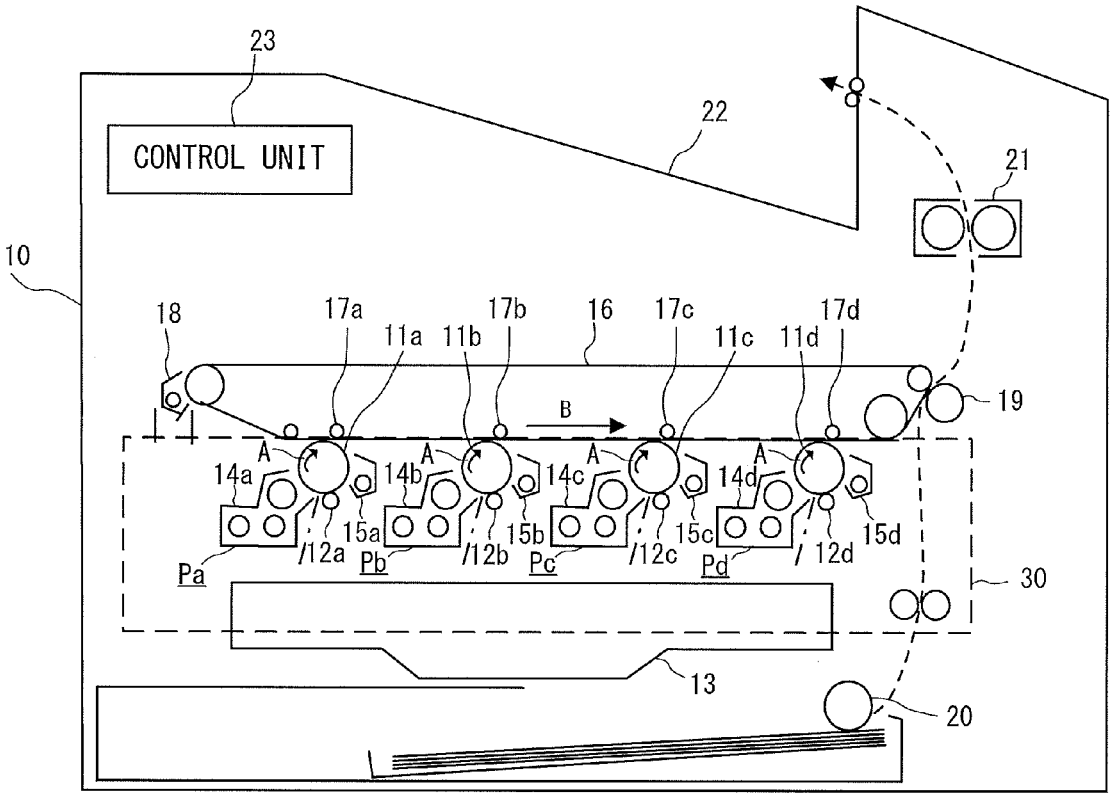
FIG. 1 is a diagram illustrating an internal configuration of an image forming apparatus.

FIG. 1 is a diagram illustrating an internal configuration of an image forming apparatus. The image forming apparatus 10 has a plurality of image forming units Pa, Pb, Pc and Pd which respectively correspond to yellow (Y), magenta (M), cyan (C) and black (K) in order and perform image formation of each color. Each of the image forming units Pa, Pb, Pc and Pd has the same configuration. In the following description, when distinguishing components by color, alphabets a, b, c, and d are placed at the end of the reference numerals. Otherwise, description will be given without placing the alphabets at the end of the reference numerals. For example, when distinguishing the image forming unit by color, it describes "image forming units Pa to Pd". Otherwise, it describes "image forming unit P".

The image forming unit P comprises a photosensitive drum 11 which is an image carrier on which a toner image is formed. The photosensitive drum is rotated by a driving unit (not shown) in a direction of an arrow A. A charging roller 12, a developing device 14, and a drum cleaner 15 are provided around the photosensitive drum 11. The charging roller 12 uniformly charges the surface of the photosensitive drum 11. An exposure unit 13 irradiates laser light, which is based on the image information, on the surface of the uniformly charged photosensitive drum 11 by the charging roller 12 to form electrostatic latent images on the photosensitive drum 11.

The developing device 14 adheres toner on the electrostatic latent images formed on the surface of the photosensitive drum 11 to form toner image. The developing device 14*a* forms a yellow toner image by a yellow toner. The developing device 14*b* forms a magenta toner image by a magenta toner. The developing device 14*c* forms a cyan toner image by a cyan toner. The developing device 14*d* forms a black toner image by a black toner.

An intermediate transfer belt 16 is placed on an upper part of the image forming unit P. The intermediate transfer belt 16 is an example of a transfer body to which the toner image formed on the photosensitive drum 11 is transferred. The intermediate transfer belt is also an example of an image carrier. The primary transfer rollers 17*a* to 17*d* are provided at positions opposing to the photosensitive drums 11*a* to 11*d* interposing the intermediate transfer belt 16 therebetween. The toner image formed on the photosensitive drum 11 is transferred to the intermediate transfer belt 16 by the primary transfer roller 17. The intermediate transfer belt 16 rotates in a direction of an arrow B. The residual toner remaining on the photosensitive drum 11 without being transferred to the intermediate transfer belt 16 is removed by the drum cleaner 15. The photosensitive drum 11 having its surface cleaned by the drum cleaner 15 prepares for the next image forming processing. The drum cleaner 15 discharges the removed residual toner in the collected toner box 30 as collected toner.

The toner image transferred to the intermediate transfer belt 16 is transferred to a recording medium such as a sheet by a secondary transfer roller 19. The recording medium is stored in a sheet feeding tray. The recording medium is conveyed to a secondary transfer roller 19 one by one from the sheet feeding tray with a sheet feeding roller 20. The recording medium having the toner image transferred thereto is conveyed to a fixing device 21 to heat and fix the toner image. The recording medium having the toner image heated and fixed is delivered to a delivery tray 22 from the fixing device 21. A belt cleaner 18 is provided around the intermediate transfer belt 16. The belt cleaner 18 removes the residual toner remaining on the intermediate belt 16 without being transferred to the recording medium. The intermediate transfer belt 16 having its surface cleaned by the belt cleaner 18 prepares for the next image forming processing. The belt cleaner 18 discharges the removed residual toner to the collected toner box 30 as collected toner.

<Configuration of Control Unit>

Figure 2:
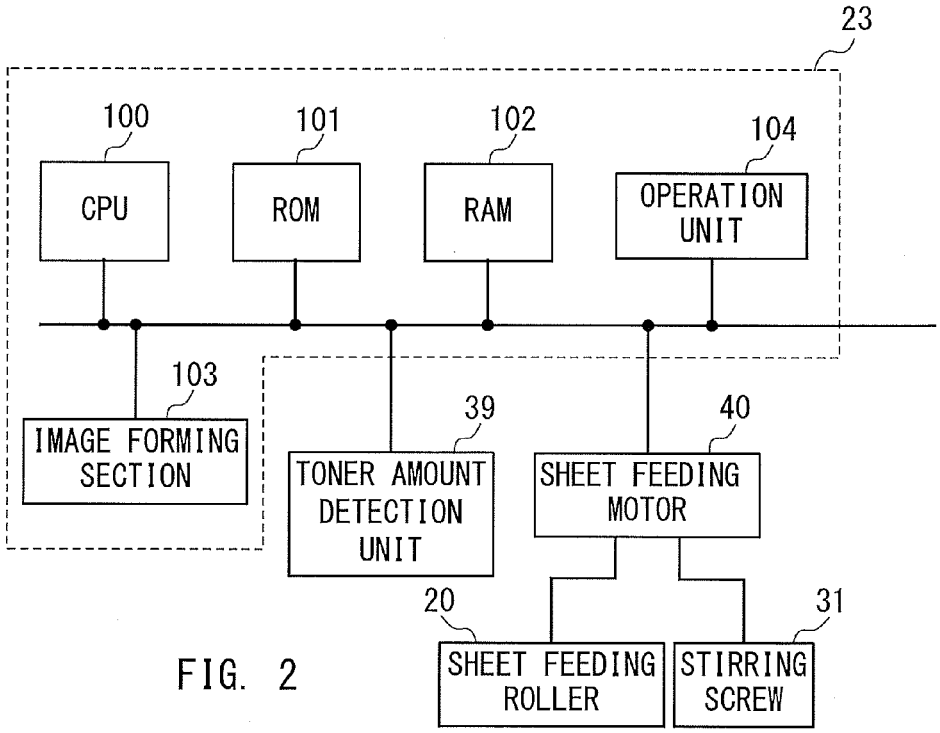
FIG. 2 is a diagram illustrating a configuration of a control unit.

The image forming apparatus 10 performs image forming processing by the following configuration. A control unit 23 controls an operation of the image forming processing. FIG. 2 is a configuration diagram illustrating the control unit 23. The control unit 23 includes a central processing unit (CPU) 100, a read only memory (ROM) 101, and a random access memory (RAM) 102. The CPU 100 controls an entire operation of the image forming apparatus 10 by reading computer program stored in the ROM 101 and executing the computer program using the RAM 102 as a work area. The RAM 102 stores image information regarding an image to be formed.

An operation unit 104 includes a liquid crystal screen and various buttons. The operation unit 104 is a user interface which receives an instruction from a user. An image forming section 103 represents the image forming unit P, the exposure unit 13, the intermediate transfer belt 16, the fixing device 21, various motors, and various sensors.

A sheet feeding motor 40 rotates and drives the sheet feeding roller 20 and a stirring screw 31 (described later) which is provided in the collected toner box 30. If the sheet feeding motor 40 is normally rotated and driven by the CPU 100, the sheet feeding motor 40 rotates the sheet feeding roller 20 and feeds the recording medium from the sheet feeding tray. While the sheet feeding motor 40 is normally rotated, the stirring screw 31 does not rotate. Also, if the sheet feeding motor 40 is reversely rotated and driven by the CPU 100, the sheet feeding motor 40 rotates the stirring screw 31 and stirs the toner in the collected toner box 30. While the sheet feeding motor 40 is reversely rotating, the sheet feeding roller 20 as mentioned above does not rotate. That is, the sheet feeding roller 20 and the stirring screw 31 never rotate and drive at the same time.

A toner amount detection unit 39 comprises an optical sensor which detects collected toner amount in the collected toner box 30. The CPU 100 monitors an output of the toner amount detection unit 39 all the time. Details of the stirring screw 31 and the toner amount detection unit 39 will be described later.

<Collected Toner Box>

FIG. 3A is a schematic cross-sectional diagram of the collected toner box when viewed from front and FIG. 3B is a schematic cross-sectional diagram of the collected toner box when viewed from back.

The collected toner box 30 is connected to the drum cleaners 15*a* to 15*d* of each of the image forming units Pa to Pd and the belt cleaner 18. The collected toner box 30 includes a storage part 32 which stores the collected toner, the stirring screw 31 which stirs the collected toner accumulated in the storage part 32, and the toner amount detection unit 39.

The storage part 32 which stores the collected toner includes receiving ports 37*a* to 37*d* and 38 which receive the collected toner discharged from the drum cleaners 15*a* to 15*d* and the belt cleaner 18. The receiving ports 37*a*, 37*b*, 37*c*, and 37*d* receive the collected toner from the drum cleaners 15*a*, 15*b*, 15*c*, and 15*d*, respectively. The receiving port 38 receives the collected toner from the belt cleaner 18. The stirring screw 31 rotates to uniformly level the surface of the collected toner accumulated in the storage part 32. The collected toner box 30 is mounted on a mounting part of the image forming apparatus 10 so as not to horizontally direct a rotation axis of the stirring screw 31. In order to prevent the toner from overflowing the receiving ports 37*a* to 37*d* disposed obliquely in a horizontal direction, the rotation axis of the stirring screw 31 is not horizontally directed.

An input gear is provided to the mounting part. When the collected toner box 30 is mounted on the mounting part, a screw flag 33, which is integrally rotated with the stirring screw 31, engages with a boss provided on the input gear. The stirring screw 31 is rotated and driven by the sheet feeding motor 40 via the boss provided on the input gear. The stirring screw 31 is rotated and driven every time it is determined that a predetermined collected toner amount is accumulated in the collected toner box 30. The timing to rotate the stirring screw 31 will be described later.

The toner amount detection unit 39 comprises an opening part 34, a detection storage part, and an optical sensor, which is provided in the detection storage part. It is noted that the opening part 34 receives the collected toner conveyed by the stirring screw 31, and the collected toner flown from the opening part 34 is accumulated in the detection storage part, which is made of a transparent member. The stirring screw 31 conveys the collected toner accumulated in the storage part 32 to the opening part through rotation. When the collected toner accumulated in the storage part 32 reaches the height of the opening part 34, it flows into an inside of the toner amount detection unit 39 (detection storage part) from the opening part 34. The optical sensor provided with the detection storage part includes a light emitting part and a light receiving part. The light receiving part is provided at a position opposing the light emission part via the detection storage part. The optical sensor outputs a signal value corresponding to a light amount (light intensity) received by the light receiving part. When the toner flown into the detection storage part is so accumulated that the light emitted from the light emission part is interrupted, the signal value which is output from the optical sensor is less than a threshold value. Based on the output signal of the optical sensor, the CPU 100 detects that the collected toner flown from the opening part 34 exceeds a certain amount.

If the signal value (output signal) which is output from the optical sensor is less than the threshold value, the CPU 100 displays a message shown in FIG. 4 on the liquid crystal screen of the operation unit 104. The message is to prompt a user to replace the collected toner box 30. When the collected toner box 30 is replaced and the signal value (output signal) which is output from the optical sensor exceeds the threshold value, the CPU 100 determines that the collected toner box 30 is replaced.

Note that, instead of the optical sensor, the toner amount detection unit 39 may adapt a noncontact type sensor such as an ultrasonic sensor, an inductance sensor and the like and a contact type sensor such as a piezo sensor or a sensor using a push switch to detect the collected toner amount.

<Timing to Stir>

FIGS. 5A to 5I are diagrams explaining timing to stir by the stirring screw 31.

The collected toner box 30 receives the collected toner from the drum cleaners 15*a* to 15*d* and the belt cleaner 18. For each of the receiving ports 37*a* to 37*d* and 38, the collected toner amount stored in the collected toner box 30 and a cumulative total of the collected amount are individually managed.

In the following description, the collected toner amount from the drum cleaner 15*a* received by the receiving port 37*a* is represented by a toner amount V (Y) and a cumulative total of the collected toner amount is represented by a cumulative total amount Mix (Y). The collected toner amount from the drum cleaner 15*b* received by the receiving port 37*b* is represented by a toner amount V (M) and a cumulative total of the collected toner amount is represented by a cumulative total amount Mix (M). The collected toner amount from the drum cleaner 15*c* received by the receiving port 37*c* is represented by a toner amount V (C) and a cumulative total of the collected toner amount is represented by a cumulative total amount Mix (C). The collected toner amount from the drum cleaner 15*d* received by the receiving port 37*d* is represented by a toner amount V (K) and a cumulative total of the collected toner amount is represented by a cumulative total amount Mix (K). The collected toner amount from the belt cleaner 18 received by the receiving port 38 is represented by a toner amount V (Tr) and a cumulative total of the collected toner amount is represented by a cumulative total amount Mix (Tr).

The collected toner received by each of the receiving port 37*a* to 37*d* is the residual toner remaining in each of the photosensitive drums 11*a* to 11*d*. It has been experimentally established that the residual toner amount is determined depending on a density of the image formed on the photosensitive drum 11. That is, if the toner amount adhering to each of the photosensitive drums 11 when forming the toner image thereon is large, the residual toner amount is also large. The collected toner amount received by the receiving ports 37*a* to 37*d* has correlation with the toner amount used to form the toner image on the photosensitive drum 11. In the present embodiment, 5[%] of the toner amount used for the toner image formed on the photosensitive drum 11 is set as the remaining toner. In addition, the toner amount used for the toner image formed on the photosensitive drum 11 is set 100 [mg] when forming an image on an entire A4 size sheet with a density of 100 [%]. The toner amount used for the toner image formed on the photosensitive drum 11 is determined based on the image information, which is calculated every time the image of one page is formed.

The collected toner received by the receiving port 38 is the residual toner remaining on the intermediate transfer belt 16. If the toner amount used for the toner image transferred to the intermediate transfer belt 16 is large, the residual toner amount is also large. Therefore, the collected toner amount received by the receiving port 38 is correlated with the toner amount of the toner images transferred to the intermediate transfer belt 16. In the present embodiment, 5[%] of the total toner amount used for the toner image transferred to the intermediate transfer belt 16 from each of the photosensitive drums 11*a* to 11*d* is set as the remaining toner.

Description is given with regard to the particular examples of how to calculate the cumulative total of the collected toner amount using FIGS. 5A to 5E. FIG. 5A represents the toner amount used for the toner image formed on each of the photosensitive drums 11*a* to 11*d* based on image information A. FIG. 5A shows the toner amount of each color, particularly, the yellow (Y) toner amount, 70 [mg], the magenta (M) toner amount, 26 [mg], the cyan (C) toner amount, 79 [mg], and the black (K) toner amount, 27 [mg].

FIG. 5B represents the collected toner amount V when the toner image is formed based on the image information A. 5[%] of the toner amount used for the toner image formed on the photosensitive drum 11 is the residual toner, which represents the toner amount V. In FIG. 5B, the yellow toner amount V (Y) is 3.5 [mg], obtained by 70*5[%]. The toner amount V of the rest of the colors is similarly obtained. In particular, the magenta toner amount V (M), 1.3 [mg], the cyan toner amount V (C), 3.95 [mg], and the black toner amount V (K), 1.35 [mg].

The toner image of the toner amount of 66.5 [mg], obtained by 70-3.5, is transferred to the intermediate transfer belt 16 from the photosensitive drum 11*a*. Similarly, from the photosensitive drum 11*b*, 24.7 [mg], from the photosensitive drum 11*c*, 75.05 [mg], and from the photosensitive drum 11*d*, 25.65 [mg] are transferred to the intermediate transfer belt 16. 5[%] of the total toner amount used for the toner image transferred to the intermediate transfer belt 16 is the residual toner, which represents a toner amount V (Tr). In FIG. 5B, the toner amount V (Tr) nearly equals to 9.6 [mg], obtained by (66.5+24.7+75.05+25.65)*5[%].

FIG. 5C represents the toner amount used for the toner image formed on each of the photosensitive drums 11*a* to 11*d* based on image information B. FIG. 5C shows the toner amounts of each color, particularly, the yellow (Y) toner amount, 53 [mg], the magenta (M) toner amount, 0 [mg], the cyan (C) toner amount, 53 [mg], and the black (K) toner amount, 26 [mg].

FIG. 5D represents the collected toner amount V when the toner image is formed based on the image information B. The toner amount V is calculated in a similar manner to that calculated in FIG. 5B. Particularly, the yellow toner amount V (Y), 2.65 [mg], the magenta toner amount V (M), 0 [mg], the cyan toner amount V (C), 2.65 [mg], and the black toner amount V (K), 1.3 [mg]. The toner amount of the intermediate transfer belt V (Tr) is 6.27 [mg].

FIG. 5E represents the cumulative total amount of the collected toner of each of the drum cleaners 15*a* to 15*d*, represented by Mix (Y), Mix (M), Mix (C), Mix (K), and that of the belt cleaner 18*b*, represented by Mix (Tr). An initial value of "0" (zero) is set to the cumulative total amounts Mix (Y), Mix (M), Mix (C), Mix (K), and Mix (Tr). The cumulative total amounts Mix (Y), Mix (M), Mix (C), Mix (K), and Mix (Tr) after the image forming processing performed based on the image information A and the image information B are obtained by adding the results shown in FIG. 5B and FIG. 5D. FIG. 5E represents the cumulative amounts of each color, particularly, the cumulative total amount Mix (Y), 6.15 [mg], the cumulative total amount Mix (M), 1.3 [mg], the cumulative total amount Mix (C), 6.6 [mg], cumulative total amount Mix (K), 2.65 [mg], and the cumulative total amount Mix (Tr), 15.87 [mg].

Threshold values Th (Y), Th (M), Th (C), Th (K), and Th (Tr) are respectively set for the cumulative total amounts Mix (Y), Mix (M), Mix (C), Mix (K), and Mix (Tr). If any one of the cumulative total amounts Mix (Y), Mix (M), Mix (C), Mix (K), and Mix (Tr) exceeds the threshold values Th (Y), Th (M), Th (C), Th (K), and Th (Tr), the CPU 100 operates the stirring screw 31 by the sheet feeding motor 40. FIG. 5F illustrates the threshold values Th (Y), Th (M), Th (C), Th (K), and Th (Tr). The threshold values Th (Y), Th (M), Th (C) and Th (K) are set as 250[mg]. The threshold value (Tr) is set as 500 [mg]. Each threshold value is a previously set value in order to avoid a situation where each of the receiving ports 37*a* to 37*d* and 38 is clogged by the collected toner. Each threshold value is set for every receiving port 37*a* to 37*d* and 38 depending on the accumulated amount of the collected toner, a shape of the collected toner box 30 and a shape of each of the receiving ports 37*a* to 37*d* and 38.

Two pages, including the image information A and the image information B, are regarded as one set. Based on this, the image forming processing is performed for 31 sets (62 pages). FIG. 5G shows the cumulative total amounts Mix (Y), Mix (M), Mix (C), Mix (K), and Mix (Tr) of the collected toner collected after the image forming processing. The cumulative total amount Mix (Y) is 190.65 [mg], which is obtained by multiplying 6.15 [mg] (the cumulative total amount Mix (Y) of each set as shown in FIG. 5E) by 31 (sets). The cumulative total amount of the rest of the colors is similarly obtained. Specifically, the cumulative total amount Mix (M) is 40.3 [mg], the cumulative total amount Mix (C) is 204.6 [mg], the cumulative total amount Mix (K) is 82.15 [mg], and the cumulative total amount Mix (Tr) is 491.97 [mg].

Thereafter, when the image forming processing based on the image information A is once more performed, the values of the cumulative total amounts Mix (Y), Mix (M), Mix (C), Mix (K), and Mix (Tr) shown in FIG. 5H are obtained, specifically, the cumulative total amount Mix (Y), 194.15 [mg], the cumulative total amount Mix (M), 41.6 [mg], the cumulative total amount Mix (C), 208.55 [mg], the cumulative total amount Mix (K), 83.5 [mg], and the cumulative total amount Mix (Tr), 501.57 [mg]. Comparing the values of the cumulative total amounts in FIG. 5H with the threshold values in FIG. 5F, it is found that the value of the cumulative total amount Mix (Tr) exceeds the threshold value Th (Tr). If the cumulative total amounts Mix (Y), Mix (M), Mix (C), Mix (K), and Mix (Tr) exceed the threshold values Th (Y), Th (M), Th (C), Th (K), and Th (Tr), the CPU 100 prohibits the execution of the image forming processing and operates the stirring screw 31.

FIG. 5I illustrates the threshold values Th (Y), Th (M), Th (C), Th (K), and Th (Tr) of another case. In FIG. 5I, the threshold values Th (K) and Th (Tr) are larger than those shown in FIG. 5F. In FIG. 5I, the threshold values Th (Y), Th (M), Th (C), Th (K), and Th (Tr) are set considering that the stirring screw 31 conveys the collected toner from the end to the center of the storage part 32 where the toner amount detection unit 39 is disposed as well as the dispositions of the receiving ports 37*a* to 37*d* and 38.

In particular, in a direction to which the collected toner is conveyed by the stirring screw 31 in the collected toner box 30, the receiving port 38 is disposed upstream of the receiving ports 37*a* and 37*b*, and the receiving port 37*d* is disposed upstream of the receiving port 37*c*. Thus, the collected toner of the rest of the colors is not added from the upstream to the collected toner received by the receiving port 37*d* by the stirring operation by the stirring screw 31. Similarly, the collected toner received by the receiving port 38 is not affected by the stirring operation. Considering the above, depending on the distance from each of the receiving ports 37*a*, 37*b*, 37*c*, 37*d*, and 38*c* to the toner amount detection unit 39, the threshold values Th (Y), Th (M), Th (C), Th (K), and Th (Tr) are set. For example, the threshold values Th (K) and Th (Tr) of the collected toner received by the receiving ports 37*d* and 38 respectively, which are positioned away from the toner amount detection unit 39, are set to be larger than the threshold values Th (Y), Th (M), and Th (C) of the collected toner received by the rest of the receiving ports 37*a*, 37*b* and 37*c*. This prolongs an interval to execute the stirring operation so that an interruption interval of the image forming processing by the stirring operation can be elongated.

<Image Forming Processing>

Figure 6:
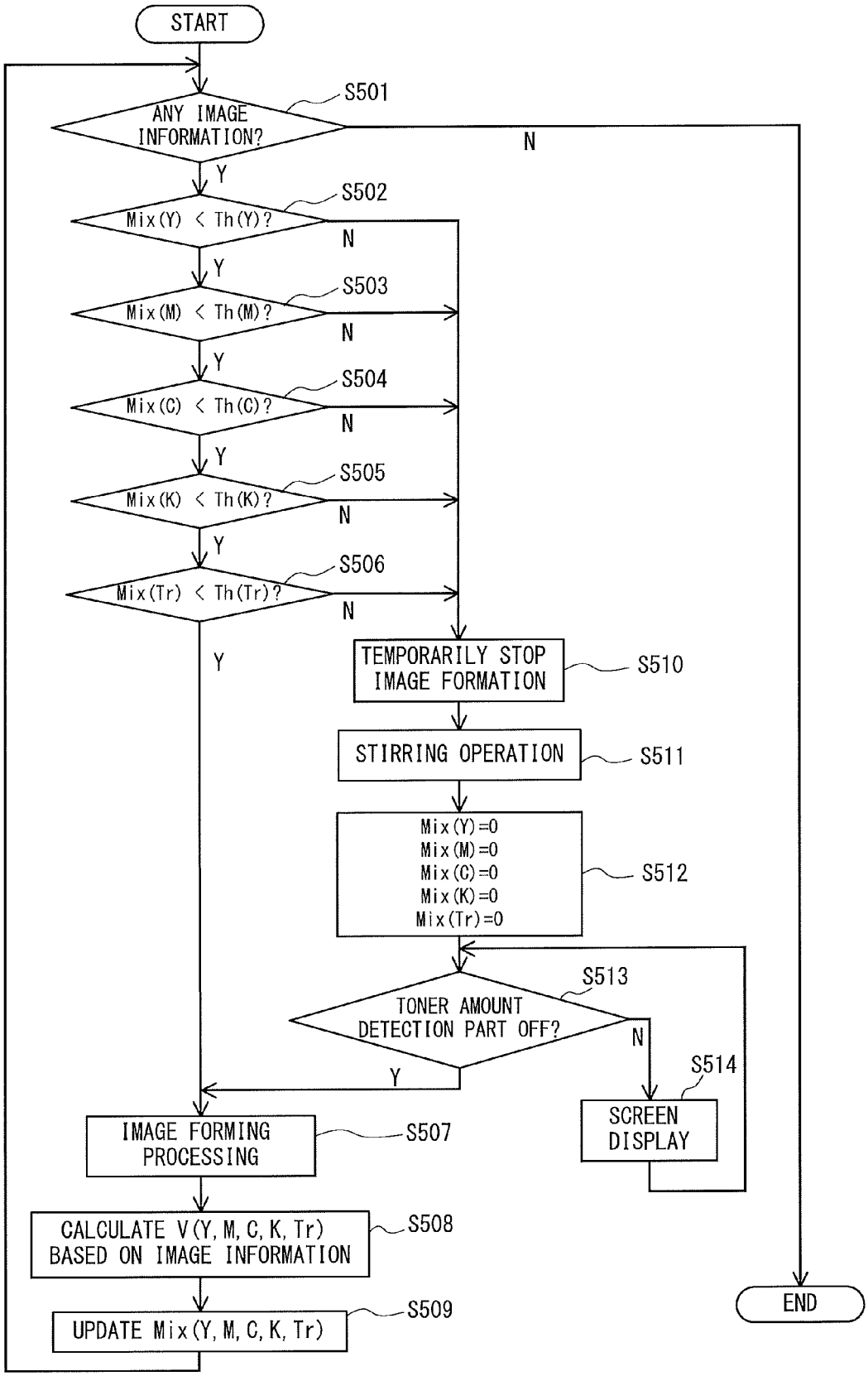
FIG. 6 is a flowchart illustrating a driving control processing of a stirring screw.

FIG. 6 is a flowchart illustrating a driving control processing of the stirring screw 31.

When an instruction to start image forming processing is received from the operation unit 104, the CPU 100 determines whether there is any image information used for image forming processing or not (S501). If it is determined that there is no image information, the CPU 100 ends the processing (S501: N). If it is determined that there is image information (S501: Y), the CPU 100 determines whether any one of the cumulative total amounts Mix (Y), Mix (M), Mix (C), Mix (K), and Mix (Tr) exceeds the corresponding threshold values Th (Y), Th (M), Th (C), Th (K), and Th (Tr) (S502 to S506).

If all the cumulative total amounts Mix (Y), Mix (M), Mix (C), Mix (K), and Mix (Tr) are less than the respective threshold values Th (Y), Th (M), Th (C), Th (K), and Th (Tr) (S502 to S506: all "Y"), the CPU 100 executes the image forming processing by the image forming section 103. At this time, the sheet feeding motor 40 drives the sheet feeding roller 20 to feed the recording medium (S507). Based on the image information used for the image formation, the CPU 100 calculates the collected toner amounts V (Y), V (M), V (C), V (K), and V (Tr) received by each of the receiving ports 37*a* to 37*d* and 38 (S508). Based on the calculated toner amounts V (Y), V (M), V (C), V (K), and V (Tr), the CPU 100 updates the cumulative total amounts Mix (Y), Mix (M), Mix (C), Mix (K), and Mix (Tr) (S509) and repeats processing from Step S501.

If any one of the cumulative total amounts Mix (Y), Mix (M), Mix (C), Mix (K), and Mix (Tr) exceeds the threshold values Th (Y), Th (M), Th (C), Th (K), and Th (Tr) (S502 to S506: any of the steps "N"), the CPU 100 temporarily stops the image forming processing (S510). The CPU 100 causes the sheet feeding motor 40 to rotate the stirring screw 31 for a predetermined time (S511). Due to this, the collected toner accumulated in the storage part 32 is uniformly leveled. After the stirring screw 31 starts to rotate, the CPU 100 zero-clears the cumulative total amounts Mix (Y), Mix (M), Mix (C), Mix (K), and Mix (Tr) (S512).

After the cumulative total amounts Mix (Y), Mix (M), Mix (C), Mix (K), and Mix (Tr) are zero-cleared, based on an output of the toner amount detection unit 39, the CPU 100 determines whether or not the collected toner flown into the opening part 34 of the toner amount detection unit 39 is less than a certain amount (S513). If it is determined that the collected toner is less than a certain amount, the image forming processing, which is temporarily stopped, is restarted (S513: Y, S507). If it is determined that the collected toner amount exceeds a certain amount, the CPU 100 prompts a user to replace the collected toner box 30 by a display message shown in FIG. 4 (S513: N, S514). The CPU 100 does not restart the image forming processing until it is determined that the collected toner box 30 is replaced and the collected toner is less than a certain amount.

Through the processing as mentioned, the CPU 100 stops the image forming processing and stirs the collected toner. In the present embodiment, the cumulative total amounts of the collected toner Mix (Y), Mix (M), Mix (C), Mix (K), and Mix (Tr) are calculated based on the toner amount used when forming image, however, the collected toner amount may be calculated considering transfer efficiency.

In the present embodiment as mentioned, the collected toner amount received by each of the receiving ports 37*a* to 37*d* and 38 of the collected toner box 30 is respectively calculated and depending on the collected toner amount as calculated, it is determined whether to perform the stirring operation of the collected toner or not. When the cumulative total of the collected toner amount as calculated exceeds the threshold value, the CPU 100 operates the stirring operation of the collected toner to uniformly level the toner. This allows the image forming apparatus 10 to store the collected toner as much as possible in the collected toner box 30 by uniformly leveling the collected toner accumulated in the storage part 32 in power-saving and low-noise modes without clogging each of the receiving ports 37*a* to 37*d* and 38 of the collected toner box 30. Also, the sheet feeding motor 40 exclusively drives the sheet feeding roller 20 and the stirring screw 31. This enables to manufacture the image forming apparatus 10 in a smaller size with more reduced cost compared with a case where a motor is respectively prepared. Since the stirring operation of the collected toner is not simultaneously executed with the image forming processing through the configuration, time to stir toner as well as time to stop image forming processing can be reduced.

While the present invention has been described with reference to exemplary embodiments and it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-073169, filed Mar. 31, 2014, which is hereby incorporated by reference wherein in its entirety.

What is claimed is:

1. An image forming apparatus comprising:

an image carrier;

an image forming unit configured to form a toner image on the image carrier by using toner, based on image information;

a transfer unit configured to transfer the toner image formed on the image carrier to a sheet;

a cleaning unit configured to clean toner on the image carrier;

a collected toner box in which the toner cleaned by the cleaning unit is collected;

a rotating member configured to be rotated for moving the toner in the collected toner box; and a controller configured to control, based on the image information, whether or not to rotate the rotating member, wherein the controller is configured to:

determine information related to a toner amount remaining on the image carrier after the toner image is transferred to the sheet from the image carrier by the transfer unit, and rotate the rotating member in a case where the information meets a predetermined condition.

2. The image forming apparatus according to claim 1, wherein the controller is configured to rotate the rotating member for a predetermined time when the information meets the predetermined condition.

3. The image forming apparatus according to claim 1, wherein the image forming unit is configured to form the toner image on a photosensitive member using toner and transfer the toner image formed on the photosensitive member to the image carrier, and wherein the cleaning unit includes a first cleaning unit and a second cleaning unit, the first cleaning unit is configured to clean toner on the photosensitive member and the second cleaning unit is configured to clean toner on the image carrier.

4. The image forming apparatus according to claim 3, wherein a first opening and a second opening are formed on the collected toner box, the first opening is provided for collecting the toner cleaned from the photosensitive member by the first cleaning unit, and the second opening is provided for collecting the toner cleaned from the image carrier by the second cleaning unit.

5. The image forming apparatus according to claim 4, wherein the controller is configured to:

rotate the rotating member when the toner amount collected from the photosensitive member meets a first condition, and rotate the rotating member when the toner amount collected from the image carrier meets a second condition which is different from the first condition.

6. The image forming apparatus according to claim 5, wherein the collected toner box further includes a detection unit configured to detect a toner amount accumulated in the collected toner box, wherein the first condition is set depending on a distance from the first opening to the detection unit, and wherein the second condition is set depending on a distance from the second opening to the detection unit.

7. The image forming apparatus according to claim 1, further comprising:

a detection unit configured to detect toner amount accumulated in the collected toner box, and an informing unit configured to inform the toner amount collected in the collected toner box based on the detection result of the detection unit.

8. The image forming apparatus according to claim 1, further comprising:

a detection unit configured to detect toner amount accumulated in the collected toner box; and a prohibition unit configured to prohibit image forming processing by the image forming unit until the collected toner box is replaced in a case where the toner amount detected by the detection unit exceeds a predetermined amount.

9. The image forming apparatus according to claim 1, wherein the predetermined condition means a condition with regard to toner amount collected in the collected toner box.

10. An image forming apparatus comprising:

an image forming unit configured to form an image, using toner, based on image data;

an image bearing member on which the image forming unit forms the image;

a conveyance unit configured to convey a sheet;

a transfer unit configured to transfer the image on the image bearing member to the sheet conveyed by the conveyance unit;

a removing unit configured to remove the toner on the image bearing member;

a waste toner container configured to receive the toner removed by the removing unit to contain the toner;

a rotating member provided in the waste toner container and configured to be rotationally driven;

a driving unit;

a controller configured to control, based on a driving mode, the driving unit; and a determination unit configured to determine, based on the image data, whether or not to cause the driving unit to rotationally drive the rotating member, wherein the driving mode includes a first mode in which the driving unit drives the conveyance unit to convey the sheet, and a second mode in which the driving unit rotationally drives the rotating member for preventing the toner from overflowing the waste toner container, wherein the rotating member is not rotationally driven by the driving unit in a state where the controller controls the driving unit based on the first mode, and wherein, during a period in which the image forming unit forms a plurality of images, in a case where the determination unit determines to cause the driving unit to rotationally drive the rotating member, the controller interrupts the control of the driving unit based on the first mode, and the controller controls the driving unit based on the second mode.

11. An image forming apparatus according to claim 10, wherein the determination unit determines a value related to the amount of the toner received in the waste toner container based on the image data, and determines whether or not to cause the driving unit to rotationally drive the rotating member based on the value.

12. An image forming apparatus according to claim 11, wherein the determination unit accumulates the value, and in a case where the accumulated value exceeds a threshold value, the determination unit determines to cause the driving unit to rotationally drive the rotating member.

13. An image forming apparatus according to claim 12, wherein the controller decreases the accumulated value in a case where the driving unit rotationally drives the rotating member.

14. An image forming apparatus according to claim 10, wherein the image forming unit interrupts the image forming of the plurality of the images in a case where the controller interrupts the control of the driving unit based on the first mode.

15. An image forming apparatus according to claim 10, further comprising a sensor configured to detect an amount of the toner in the waste toner container, wherein the determination unit includes an inhibit unit configured to inhibit image forming by the image forming unit in a case where the amount of the toner in the waste toner container detected by the sensor exceeds a predetermined amount.

16. An image forming apparatus according to claim 10, wherein the image forming unit includes:

a first image forming unit including a first photosensitive member, the first image forming unit forming a first image on the first photosensitive member using a first color toner, and a second image forming unit including a second photosensitive member, the second image forming unit forms a second image on the second photosensitive member using a second color toner, the second color differs from the first color, wherein the removing unit includes a first removing unit configured to remove toner on the first photosensitive member, a second removing unit configured to remove toner on the second photosensitive member, and a third removing unit configured to remove toner on the image bearing member, wherein the determination unit is configured to determine a first value, a second value and a third value based on the image data, the first value relating to an amount of the toner removed from the first photosensitive member by the first removing unit, the second value relating to an amount of the toner removed from the second photosensitive member by the second removing unit, and the third value relating to an amount of the toner removed from the image bearing member by the third removing unit, and wherein the determination unit determines whether or not to cause the driving unit to rotationally drive the rotating member based on the first value, the second value and the third value.

17. An image forming apparatus according to claim 16, wherein the determination unit is configured to:

cause the driving unit to rotationally drive the rotating member when the first value exceeds a first threshold value, cause the driving unit to rotationally drive the rotating member when the second value exceeds a second threshold value, and cause the driving unit to rotationally drive the rotating member when the third value exceeds a third threshold value, and wherein the first threshold value differs from the second threshold value, the second threshold value differs from the third threshold value, and the third threshold value differs from the first threshold value.

18. An image forming apparatus according to claim 16, wherein the waste toner container includes a first opening, a second opening and a third opening, and wherein the toner removed by the first removing unit passes through the first opening, the toner removed by the second removing unit passes through the second opening, and the toner removed by the third removing unit passes through the third opening.

* * * * *